US005725412A

United States Patent [19]

Ishimoto

[11] Patent Number: 5,725,412

[45] Date of Patent: Mar. 10, 1998

[54] JUMPING MECHANISM FOR A RADIO CONTROLLED TOY CAR

[75] Inventor: Zenichi Ishimoto, Tokyo, Japan

[73] Assignee: Nikko Co., Ltd., Tokyo, Japan

[21] Appl. No.: 711,233

[22] Filed: Sep. 9, 1996

[30] Foreign Application Priority Data

Sep. 7, 1995 [JP] Japan ..... 7-229749

[51] Int. Cl.[6] ..... A63H 17/00

[52] U.S. Cl. ..... 446/437; 446/456

[58] Field of Search ..... 446/437, 456, 446/356, 355, 308, 309, 311, 462

[56] References Cited

U.S. PATENT DOCUMENTS

| | | | |
|---|---|---|---|
| 2,247,354 | 7/1941 | Berger | 446/437 |
| 4,363,187 | 12/1982 | Shinohara . | |
| 4,892,503 | 1/1990 | Kumazawa | 446/437 X |

FOREIGN PATENT DOCUMENTS

| | | | |
|---|---|---|---|
| 939 439 | 2/1956 | Germany . | |
| 383128 | 11/1932 | United Kingdom | 446/312 |
| 641563 | 8/1950 | United Kingdom | 446/437 |
| 2 212 408 | 7/1989 | United Kingdom . | |

*Primary Examiner*—Mickey Yu
*Attorney, Agent, or Firm*—Young & Thompson

[57] ABSTRACT

A jumping mechanism for a radio-controlled toy vehicle with a slender opening provided in a chassis of a toy vehicle; a rotary shaft provided on the chassis in a lateral direction, vertical to a longitudinal direction of the opening; a rotation mechanism mechanically connected to a first portion of the rotary shaft for rotating the rotary shaft; and at least a rotation arm being mechanically connected to a second portion of the rotary shaft and extending in a vertical direction in relation to the axis of the rotary shaft and having a rotation center positioned over the opening so that the rotation arm rotates in a plane vertical to the axis of the rotary shaft and so that, when the rotation arm is directed downward it passes through the opening of the chassis wherein a top portion of the rotation arm is positioned below the bottom level of the toy vehicle.

6 Claims, 6 Drawing Sheets

JUMPING MECHANISM FOR A RADIO CONTROLLED TOY CAR

BACKGROUND OF THE INVENTION

The present invention relates to a radio-controlled toy vehicle, and more particularly to a jumping mechanism that enables a toy vehicle to jump in a radio-controllable manner.

A radio-controlled toy vehicle generally comprises driving means such as a motor, a gear mechanism for transmitting a driving force of a driving means to a driving wheel, a steering mechanism for steering the toy vehicle, and a control means for controlling the above. A radio-controlled toy vehicle thus constructed can be made to move forward and backward and to turn by transmitting a control signal via a radio transmitter.

Although radio-controlled toy vehicles can be made to advance, retreat and turn, they are presently not provided with a jumping mechanism enabling them to jump in a controllable manner.

SUMMARY OF THE INVENTION

Accordingly, it is an object of the present invention to provide a jumping mechanism of a simple construction enabling a toy vehicle to jump in a controllable manner.

It is a further object of the present invention to provide a jumping mechanism enabling a toy vehicle to jump over obstacles.

The above and other objects, features and advantages of the present invention will be apparent from the following descriptions.

The present invention provides a jumping mechanism for a radio-controlled toy vehicle comprising a slender opening in the chassis of a toy vehicle, a rotary shaft, a rotation mechanism for rotating the rotary shaft, and at least a rotation arm. The rotary shaft is capable of rotating on its axis and is provided on the chassis extending in a lateral direction, perpendicular to the longitudinal direction of the opening. The means for rotating the rotary shaft is mechanically connected to a first portion of the rotary shaft and the rotation arm is mechanically connected to a second portion of the rotary shaft. The rotation arm extends in a perpendicular direction to the axis of the rotary shaft. The rotation arm's rotation center is positioned over the opening so that the rotation arm rotates in a plane perpendicular to the axis of the rotary shaft and so that, when directed downward, the rotation arm passes through the opening and a top portion of the rotation arm is positioned below the toy vehicle.

The rotation mechanism may comprise a motor and a rotation transmission gear system, wherein the rotation transmission gear system mechanically connects the motor and the rotation shaft and transmits the rotational force of the motor to the rotary shaft, and wherein the motor and the transmission gear system are operable independently of the driving system of the toy vehicle.

The rotation mechanism may also comprise a driving motor, a rotation transmission gear system, and a rotation transmission controller, wherein the rotation transmission gear system mechanically connects the driving motor to the rotation shaft and transmits the rotational force of the driving motor to the rotation shaft, and wherein the rotation transmission controller is mechanically connected to the rotation shaft for controlling the transmission of the rotational force.

The rotation transmission controller may comprise an auxiliary motor, a first rotation transmission gear having a rotation center being mechanically connected to the auxiliary motor, and at least a second rotation transmission gear being engaged with the first gear and having a rotation center that is mechanically connected to the rotation shaft for transmitting the rotational force of the auxiliary motor to the rotation shaft in cooperation with the first transmission gear. The second transmission gear is mechanically engaged with the rotation transmission system and has a peripheral portion which is partially provided with a recessed portion so that the second transmission gear is normally disengaged through the recessed portion from the rotation transmission system to prevent the transmission of rotational force to the rotation shaft.

In addition, the first rotation transmission gear may be provided with a one-way clutch so that only a rotation of the auxiliary motor is transmitted to the second rotation transmission gear.

The jumping mechanism may further include the following elements. A first main arm is provided, which has a first end being mechanically connected to the rotation shaft. A second main arm is provided, which has a first end being pivotally connected to the opposite end of the first main arm. The second main arm is capable of being positioned at various angles in relation to the first main arm. A rotation plate is provided, which has a rotation center being mechanically connected with the first end of the first main arm for showing a rotation in a vertical plane. An auxiliary arm is provided, which has a first end being mechanically connected to an eccentric position of the rotation plate. The eccentric position is distanced from the rotation center of the rotation plate. The auxiliary arm has a second end being mechanically connected to the second main arm near the first end thereof. The angle of the second main arm in relation to the first main arm becomes larger when the rotation arm is directed downward, whilst the angle of the second main arm in relation to the first main arm becomes smaller when the rotation arm is directed upward.

BRIEF DESCRIPTIONS OF THE DRAWINGS

Preferred embodiments of the present invention will hereinafter be described in detail with reference to the accompanying drawings.

PREFERRED EMBODIMENTS

Figure 1:
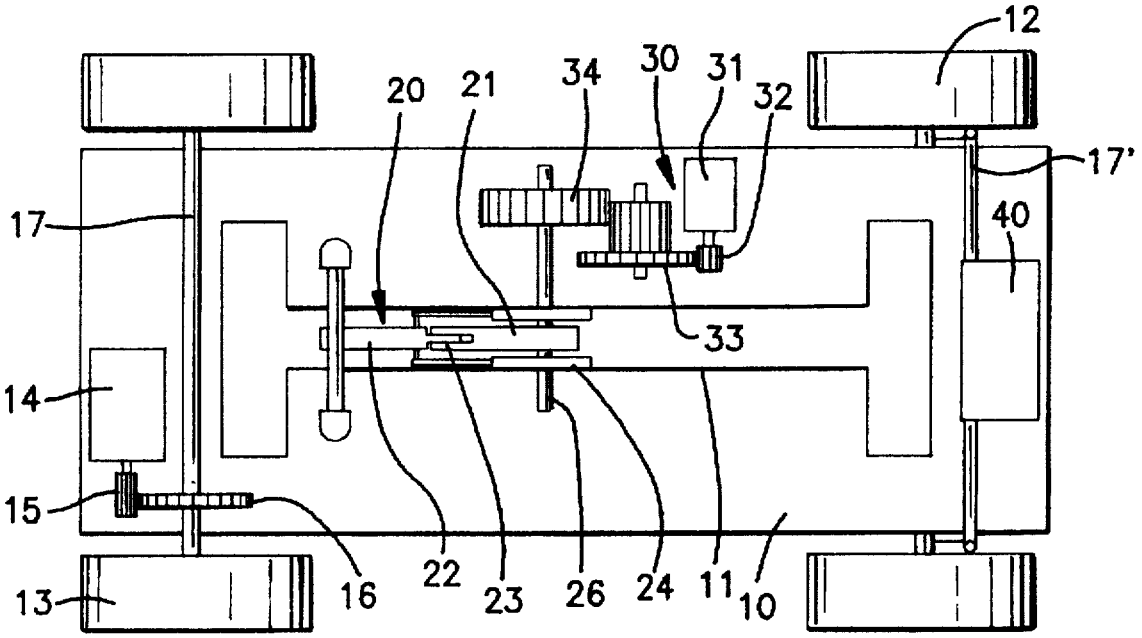
FIG. 1 is a plane view illustrative of the jumping mechanism provided in a radio-controlled toy vehicle according a first embodiment of the present invention.

A first embodiment of the present invention will be described wherein a radio controlled toy vehicle with a jumping mechanism is provided. With reference to FIG. 1, the jumping mechanism is provided on a chassis 10 of the radio controlled toy vehicle. The chassis 10 is provided with a pair of front wheels 12 connected to each other through a rotary shaft 17' and a pair of rear wheels 13 connected to each other through a driving shaft 17. The chassis 10 is formed with a slender opening portion 11 extending in the longitudinal direction at the center. A rotary shaft 26 is further provided across the slender opening portion 11 in a lateral direction. A rotation arm 20 is mechanically connected to the rotary shaft 26 and provided pivotably through the slender opening portion 11. A rotation mechanism 30 is provided for rotating the rotation arm 20 around the rotary shaft 26.

In addition, a driving motor 14 is provided at a rear end of the chassis 10 for generation of a driving power for traveling the toy vehicle forward or backward. A gear 15 is connected to a shaft of the driving motor 14. A gear 16 is provided on the driving shaft 17 connecting the rear wheels 13. The gear 16 is mechanically engaged with the gear 15 so that the driving power of the driving motor 14 is transmitted through the gears 15 and 16 and the driving shaft 17 to the rear wheels 13.

A magnetic steering unit 40 is provided at a front end of the chassis 10 for turning the front wheels 12 into leftward and rightward and for steering the vehicle. A control unit not illustrated is further provided on the chassis 10 for controlling the operations of the toy vehicle. As a modification, it is possible to optionally provide a plurality of additional gears between the gears 15 and 16 for adjusting the gear ratio.

With reference to FIG. 1, the rotation arm 20 comprises a main arm 27 and an auxiliary arm 28. The main arm 27 further comprises a first member 21 and a second member 22 pivotally connected to the first member 21. The first member 21 has a first end mechanically and pivotally connected to the shaft 26 for rotation around the shaft 26 and supported on the chassis 10. The first member 21 has a second end mechanically and pivotally connected via a fulcrum 23 to a first end of the second member 22 so that the second member 22 rotates around the fulcrum 23. The second member 22 has a second end which is provided with a laterally extending bar so that the second member 22 is T-shaped in the plane view. The slender opening portion 11 is further formed at its opposite ends with laterally extending opening portions so that the slender opening portion 11 and the laterally extending opening portions form an H-shaped opening portion. The laterally extending bar provided to the second member 22 is smaller in length than the laterally extending opening portions so that the laterally extending bar may pass through the laterally extending opening portions.

The auxiliary arm portion 28 comprises two pairs of rotation plates 24 and third members 25. Each of the third members 25 has a first end secured to the rotation plate 24 and a second end secured to the second member 22. Each of the rotation plates 24 is positioned in the slender opening portion 11 and supported by the shaft 26 at its eccentric position.

The driving unit 30 comprises a motor 31, a gear 32 having a rotation center mechanically connected to a shaft of the motor 31, a counter gear 33 mechanically engaged with the gear 32, and a gear 34 mechanically engaged with the counter gear 33 and having a rotation center mechanically connected to the rotary shaft 26. As a modification, it is possible to optionally provide a plurality of additional gears between the gears 33 and 34 for adjusting a gear ratio.

Figure 3:
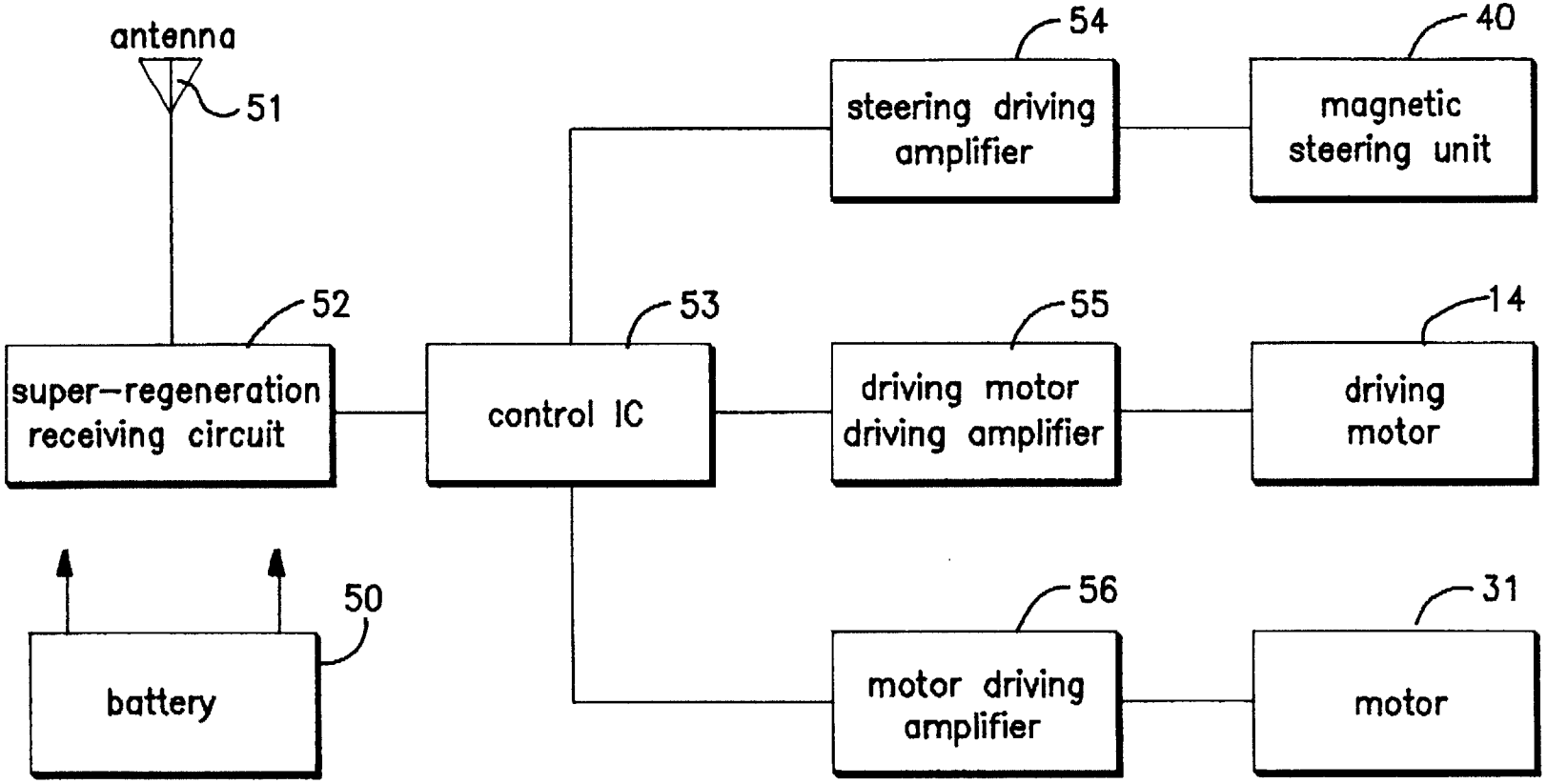
FIG. 3 is a block diagram illustrative of a control unit for controlling the jumping mechanism and placed in a radio-controlled toy vehicle according to the first embodiment of the present invention.
Figure 4:
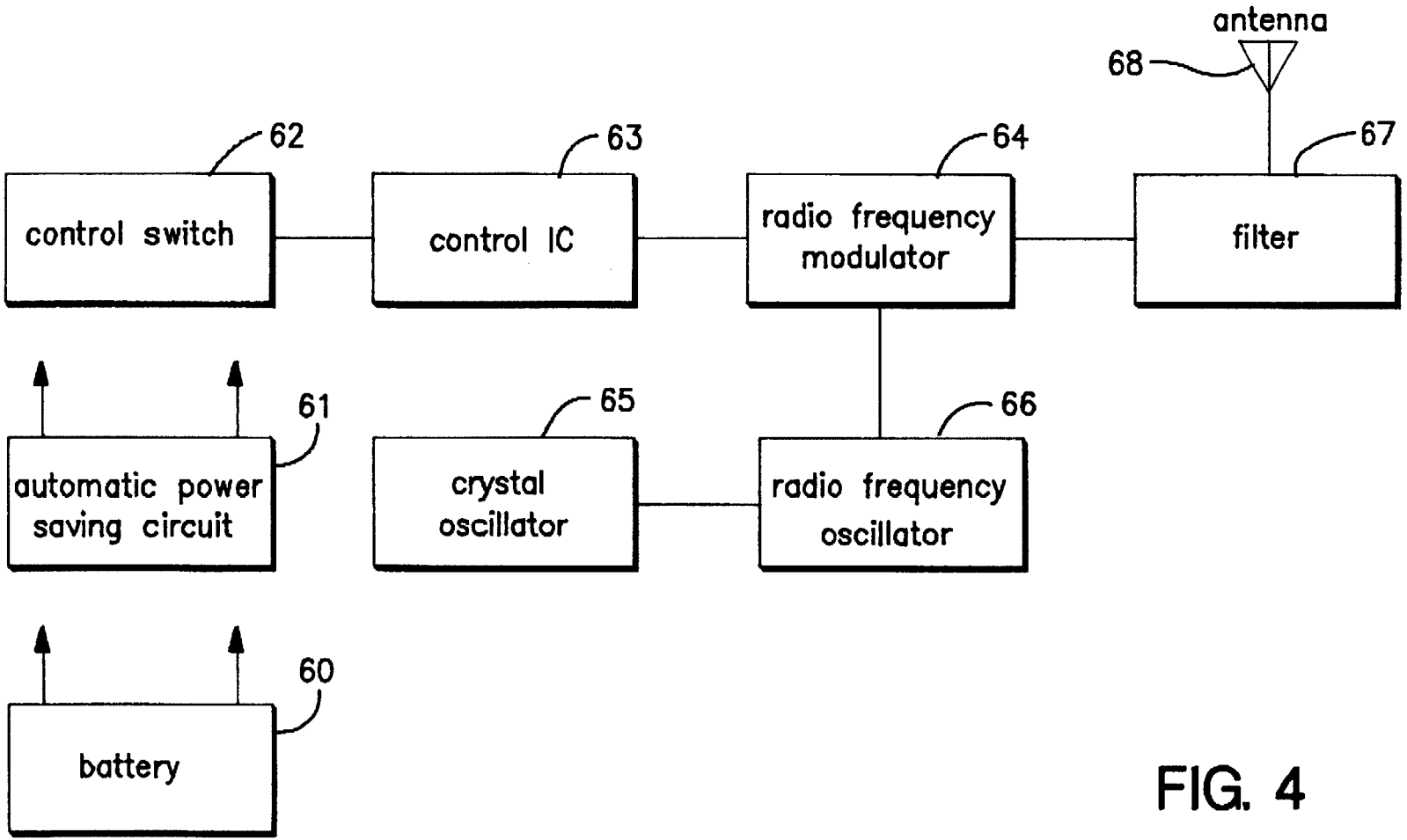
FIG. 4 is a block diagram illustrative of a control unit of a transmitter for transmitting a control signal to a control unit placed in a radio-controlled toy vehicle according to the present invention.

With reference to FIG. 3, the control unit comprises the following elements. A battery 50 is provided, for example, on a bottom of the chassis 10 for supplying a power. An antenna 51 is provided for receiving control signals having been transmitted from a transmitter to be described below with reference to FIG. 4. A super reproduction receiver circuit 52 is provided and electrically connected to the antenna 51 for receiving and reproducing control signals once received by the antenna 51. A control IC 53 is provided and electrically connected to the super reproduction receiver circuit 52 for fetching the reproduced control signals from the super reproduction receiver circuit 52 and generating steering signals, driving signals and jumping signals. A steering driving amplifier 54 is provided and electrically connected to the control IC 53 for fetching the steering signals from the control IC 53 and amplifying the steering signals. A driving motor driving amplifier 55 is provided and electrically connected to the control IC 53 for fetching the driving signals from the control IC 53 and amplifying the driving signals. A motor driving amplifier 56 is provided and electrically connected to the control IC 53 for fetching the jumping signals from the control IC 53 and amplifying the jumping signals. The magnetic steering unit 40 is electrically connected to the steering driving amplifier 54 for receiving the amplified steering signals so that the magnetic steering unit 40 performs the steering operations in accordance with the received steering signals. The driving motor 14 is electrically connected to the driving motor driving amplifier 55 for receiving the amplified driving signals so that the driving motor 14 rotates in accordance with the received driving signals. The motor 31 for the jumping mechanism is electrically connected to the motor driving amplifier 56 for receiving the amplified jumping signals so that the motor 31 rotates in accordance with the received jumping signals.

As described above, the motor 31 for the jumping mechanism may be controlled separately from the driving motor 14 for traveling the radio-controlled toy vehicle. Notwithstanding, the driving motor driving amplifier 55 and the motor drive amplifier 56 are electrically connected to each other for associative operations thereof so that the motor driving amplifier 56 is operable only when received a rotation-enable signal from the driving motor driving amplifier 55. Namely, in the first embodiment, the jumping mechanism is operable only when the radio-controlled toy car travels in the forward direction.

The transmitter includes a battery 60 for supplying a power and an automatic power save circuit 61 for automatically cutting off the power when the vehicle is not in operation for a predetermined time period. The transmitter further includes a control switch 62 for providing instructions of forward and reverse travels, leftward and rightward turns and jump motions of the toy car. The transmitter furthermore includes a control IC 63 for generating a control signal according to the signal from the control switch 62. The transmitter still further includes a radio frequency oscillator 66 for oscillating a radio frequency based on a clock of a crystal oscillator 65 and a radio frequency modulator 64 for modulating a control signal by a radio frequency, and a filter 67 for filtering the modulated signal, and an antenna 68 for transmitting the filtered signal to the antenna of the toy vehicle.

When a signal instructing a toy vehicle to move forward is transmitted by the transmitter and received by the control unit on the toy vehicle, then a command for starting the driving motor 14 is transmitted from the control IC 53 to the driving motor driving amplifier 55. As a result, the driving motor 14 starts and the toy vehicle moves forward. At the same time, an enabling signal is transmitted from the driving motor driving amplifier 55 to the motor driving amplifier 56 whereby the jumping mechanism becomes operable.

Figure 5:
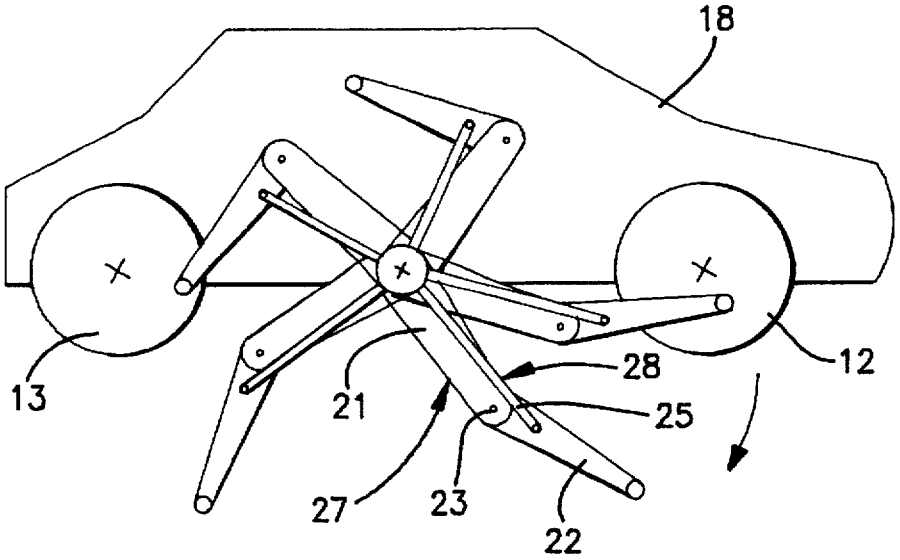
FIG. 5 is a schematic view illustrative of the operation of the rotation arm of the jumping mechanism placed in a radio-controlled toy vehicle according to the first embodiment of the invention.
Figure 6:
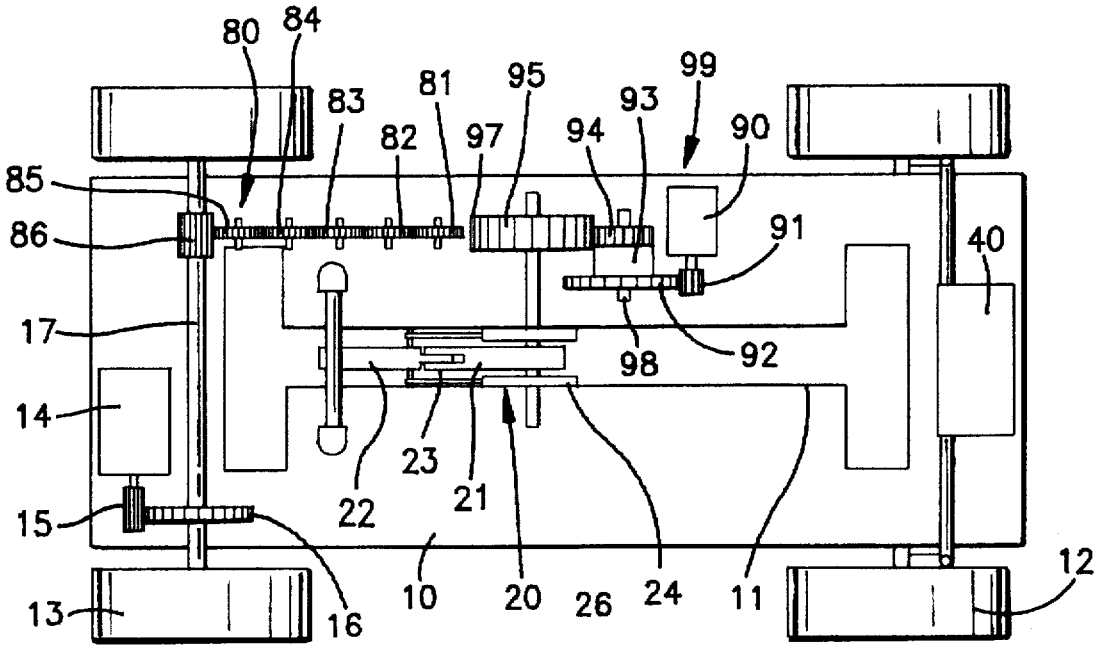
FIG. 6 is a plane view illustrative of the jumping mechanism provided in a radio-controlled toy vehicle according a second embodiment of the present invention.
Figure 7:
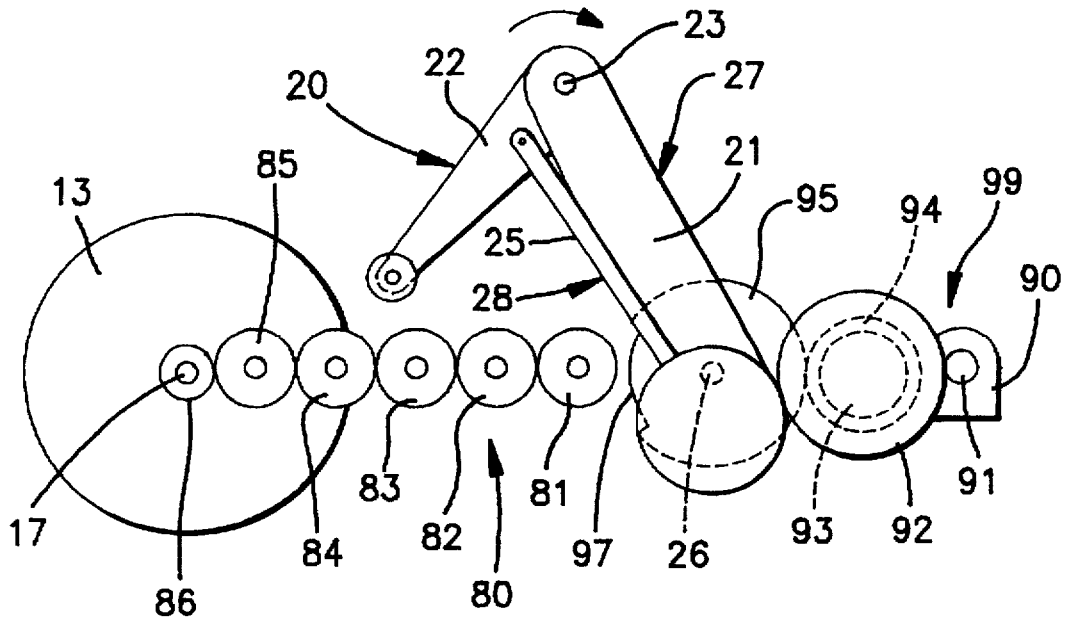
FIG. 7 is a schematic view illustrative of a side view illustrative of the jumping mechanism according to a second embodiment of the present invention.

When a signal instructing a toy vehicle to jump is transmitted from the transmitter, then a command for starting the motor 31 is transmitted from the control IC 53 to the motor driving amplifier 56. As a result, the gear 32, the counter gear 33, the gear 34, and the rotation shaft 26 are set in motion by the motor 31, and further the rotation arm 20 begins to rotate. The rotation arm 20 having been folded in its resting position above the chassis 10 becomes linearly extended as it moves below the chassis through the open portion and towards the driving surface as shown in FIG. 5. The folded rotation arm 20 linearly extends through the concerted operation of the main arm portion 27, the rotation plate 24, the auxiliary arm portion 28 and the rotation shaft 26. Furthermore, the third member 25 provided on the rotation plate 24 is connected to the second member 22 of the main arm portion 27.

Therefore, the auxiliary arm portion 28 is connected to the center of the rotation plate 24 which eccentric position is connected to the rotation shaft 26 which is connected to the main arm 27. The auxiliary arm portion 28 rotates together with the main arm 27 around the rotation shaft 26. When the rotation arm 20 is positioned above the chassis 10, the second member 22, pivotably secured to the first member of the main arm portion 27, folds towards the first member 21, and further the main arm portion 27 is folded at the fulcrum 23. By contrast, when the rotation arm 20 is directed below the chassis 10, the auxiliary arm portion 28 pushes the second member 22 outward to extend the main arm 27 linearly.

Figure 2:
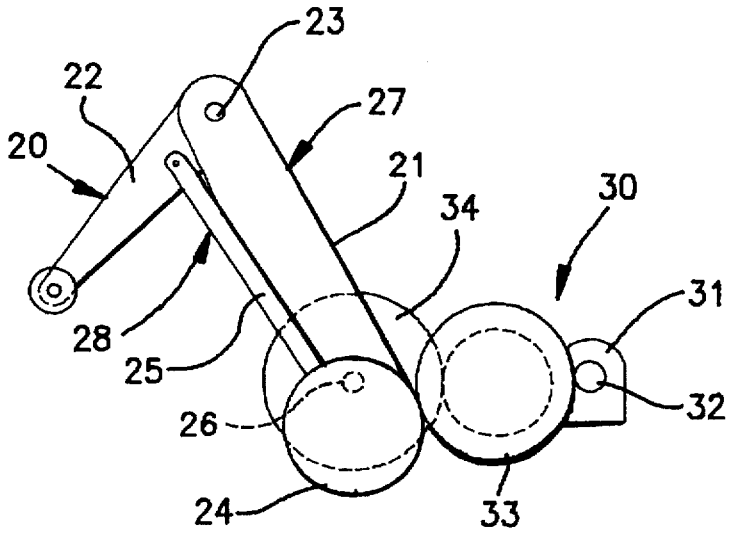
FIG. 2 is a schematic view illustrative of a side view illustrative of the jumping mechanism according to a first embodiment of the present invention.

At the same time when the rotation arm 20 folded linearly extends, the end portion of the second member 22 of the main arm portion 27 is made into contact with the ground, so that the rotation arm kicks down upon the ground thereby causing the toy vehicle to jump. Moreover, the second member 22 of the main arm portion 27 is T-shaped bar as illustrated in FIG. 2. This provides stability to the jumping motion of the toy vehicle.

When the vehicle lands, the rotation arm 20 is folded by the action of the auxiliary arm portion 28 described above.

A second embodiment of the present invention is described in detail by referring to the drawing. The structure of the toy vehicle is different from that of the first embodiment in the following matters. In the second embodiment, the rotary shaft 26 rotates by a driving motor 14. In addition, a rotation transmission controller 99 is further provided for controlling the starting of the jumping mechanism. The following description focus on the structural difference of the toy vehicle of this embodiment from that of the first embodiment.

The rotation arm 20 is secured to one end of the shaft 26 in the same manner as in the first embodiment, and supported on the chassis 10. At the other end of the rotation shaft 26 a gear 95 is provided with a recessed portion 97. The recessed portion 97 will be described below.

The gear 95 is connected to the driving motor 14 via a rotation transmission gear system 80. The rotation transmission gear system 80 comprises a plurality of gears 81 through 85. The gear 85 is mechanically engaged with a gear 86 provided on the driving shaft 17 to transmit the rotational force of the driving motor 14 to the gear 95. In this way, the driving motor 14 and the rotation arm 20 can be connected via a plurality of gears and the power of the driving motor 14 can be utilized for both the jumping and driving functions of the vehicle. It should be noted, however, that the actual coupling method and number of gears making up the rotation transmission gear system 80 can be varied, taking such factors as the desired gear ratio and length of the chassis 10 into consideration.

As long as the gear 95 is engaged with the gear 81 constituting the rotation transmission gear system 80, the rotation arm 20 rotates when the toy vehicle travels. Therefore, the above-described recessed portion 97 is provided on the gear 95 so that it is not engaged with gear 81 of the driving force transmission unit 80 when the toy vehicle is travelling normally.

Since the recessed portion 97 is provided, the rotation transmission controller 99 is provided to rotate the gear 95 at a predetermined degree in order to couple it with the rotation transmission gear system 80.

The rotation transmission controller 99 comprises an auxiliary motor 90, a gear 91 connected to the shaft of the auxiliary motor 90, a gear 92 mechanically engaged with the gear 91 and a gear 94 provided on the same shaft 98 as gear 92. By actuating the auxiliary motor, the gear 95 can be coupled with the rotation transmission gear system 80 and the toy vehicle can be made to jump by the resulting movement of the rotation shaft 26 and rotation arm 20.

According to the present embodiment, the gear 95 is rotated by the driving motor 14. In order to prevent the simultaneous rotation of the entire jump start unit 99 at the time of jumping, a one-way clutch 93 is provided.

In other words, provision of the one-way clutch 93 on the gear 94 makes the driving power of the jump start motor 90 transmit via the rotation of the shaft 98 rotated by the gear 92 to the gear 94. On the other hand, in jumping, the gear 95 rotates by the driving motor 14 whereby the gear 94 in the jump start unit 99 rotates in an opposite direction to that in use of the jump start motor 90, for which reason the one-way clutch 93 is in the idling state whereby the driving power of the driving motor 14 is not transmitted to the gear 92.

Figure 8:
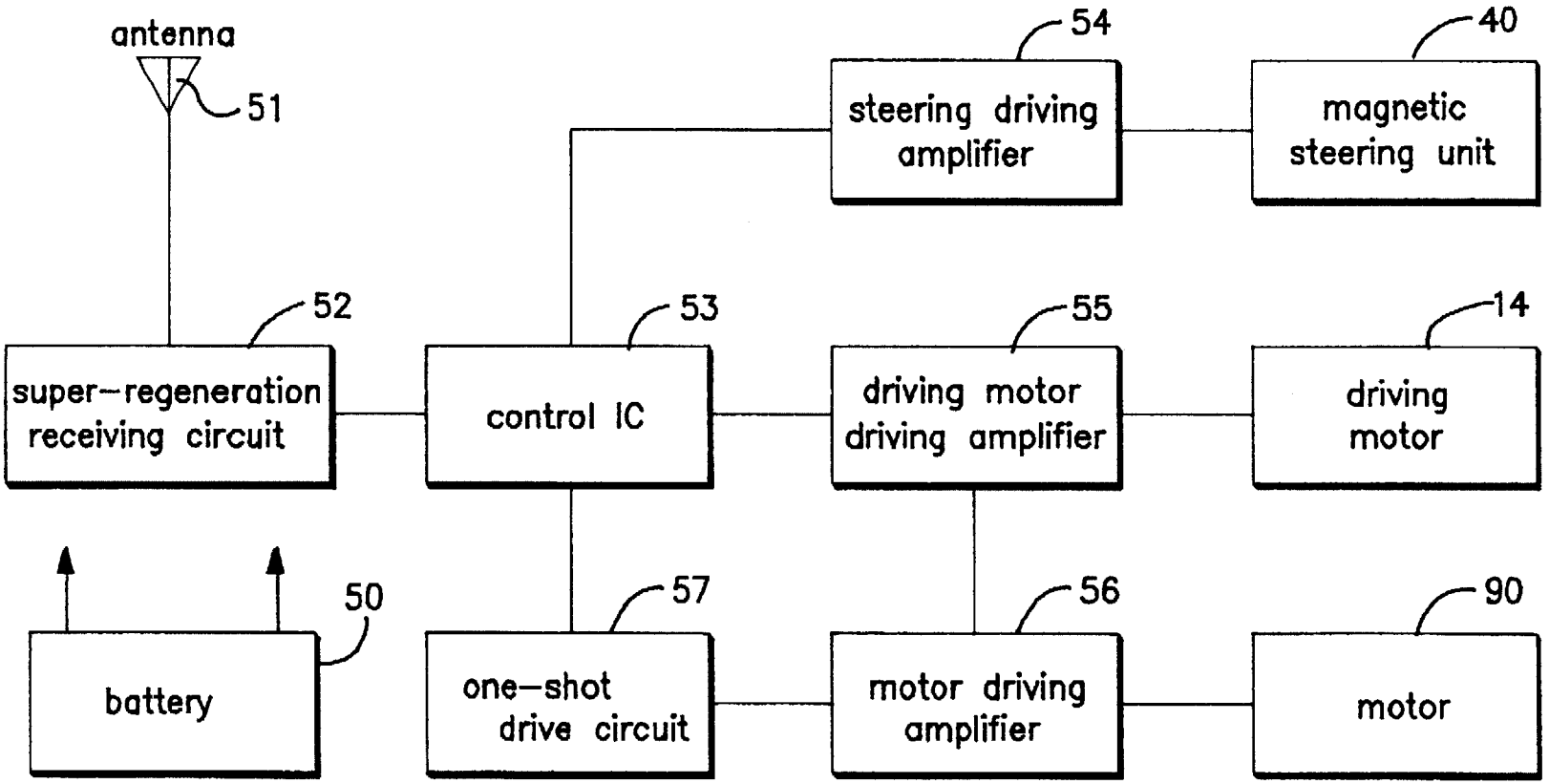
FIG. 8 is a block diagram illustrative of a control unit for controlling the jumping mechanism and placed in a radio-controlled toy vehicle according to a second embodiment of the present invention.

FIG. 8 is illustrative of a control unit of the toy car in this embodiment. The structure of the control unit is different from that of the first embodiment in further providing a one shot driving circuit 57 between the control IC 53 and the motor driving amplifier 56 for controlling the jump start motor.

In accordance with the signal from the transmitter, a jump command is generated from the control IC and then inputted into the one shot driving circuit 57 before a control signal is supplied from the one shot driving circuit 57 to the motor driving amplifier 56 for rotation of the jump start motor at a predetermined angle whereby the gear 95 is engaged with the rotation transmission gear system 80.

When the gear 95 is engaged with the rotation transmission gear system 80, the rotation arm 20 rotates to have the toy car jump. The gear 95 rotates one time, the recessed portion 97 faces the rotation transmission gear system 80 whereby the gear 95 is disengaged from the rotation transmission gear system 80. As a result, the driving power of the driving motor 14 is not transmitted to the gear 95 whereby the rotation of the rotation arm 20 is discontinued.

In this second embodiment, the rotation arm 20 rotates by the driving power of the jumping start motor 90 for jumping motion with a high amount of power. On the other hand, the jumping start motor 90 is required to rotate the gear 95 at only a predetermined angle. This allows the use of a small motor resulting in a reduction in weight of the toy vehicle. This allows the toy car to jump a further distance.

Whereas any further modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A jumping mechanism in a toy vehicle comprising:

a chassis of said toy vehicle;

an opening portion in said chassis of said toy vehicle, said opening portion having a slender shape;

a rotatable rotary shaft on said chassis and extending in a lateral direction, perpendicular to a longitudinal direction of said opening portion;

means for rotating said rotary shaft 360 degrees and mechanically connected to a first portion of said rotary shaft; and at least a rotation arm mechanically connected to a second portion of said rotary shaft, said rotation arm extending in a perpendicular direction to said rotary shaft and said rotation arm having a rotation center being positioned over said opening portion so that said rotation arm rotates in a plane perpendicular to said rotary shaft, and so that when said rotation arm is directed downward, said rotation arm penetrates said opening portion of said chassis wherein a distal end of said rotation arm is positioned below a bottom level of said toy vehicle from a position above said bottom level.

2. The jumping mechanism as claimed in claim 1, wherein said rotating means comprises:

a motor; and a rotation transmission gear system mechanically connecting said rotation shaft to said motor for transmitting a rotation force of said motor to said rotary shaft;

wherein said motor and said transmission gear system are operable independently from a driving system of said toy vehicle.

3. The jumping mechanism as claimed in claim 1, wherein said means for rotating comprises:

a driving motor;

a rotation transmission gear system mechanically connecting said driving motor and said rotary shaft for transmitting a rotation force of said driving motor to said rotary shaft; and a rotation transmission controller mechanically connected to said rotary shaft for controlling transmission of said rotation force.

4. A jumping mechanism in a toy vehicle comprising:

a chassis;

an opening portion longitudinally aligned in said chassis;

a rotary shaft on said chassis and extending in an lateral direction;

means for rotating said rotary shaft, said rotating means comprising a driving motor, a rotation transmission gear system mechanically connecting said driving motor and said rotary shaft for transmitting a rotation force from said driving motor to said rotary shaft, and a rotation transmission controller mechanically connected to said rotary shaft for controlling transmission of said rotation force, said rotation transmission controller comprising an auxiliary motor; a first rotation transmission gear having a rotation center mechanically connected to said auxiliary motor; and at least a second rotation transmission gear engaged with said first gear and having a rotation center mechanically connected to said rotary shaft for transmitting a rotation of said auxiliary motor to said rotary shaft in cooperation with said first transmission gear, said second transmission gear being mechanically engaged with said rotation transmission system, said second transmission gear having a peripheral portion which is partially provided with a recessed portion so that said second transmission gear is disengaged through said recessed portion from said rotation transmission system to prevent transmission of said rotation force to said rotary shaft; and at least a rotation arm mechanically connected to a second portion of said rotary shaft, said rotation arm extending in a perpendicular direction to said rotary shaft and said rotation arm having a rotation center positioned over said opening portion so that said rotation arm rotates in a plane perpendicular to said rotary shaft, and so that when said rotation arm is directed downward, said rotation arm penetrates said opening portion wherein a distal end of said rotation arm is positioned below said chassis.

5. The jumping mechanism as claimed in claim 4, wherein said first rotation transmission gear is further provided with a one-way clutch so that a rotation of said auxiliary motor is transmitted to said second rotation transmission gear.

6. A jumping mechanism in a toy vehicle comprising:

a chassis;

an opening portion longitudinally aligned in said chassis;

a rotary shaft on said chassis and extending in an lateral direction;

means for rotating said rotary shaft; and a rotation arm comprising a first main arm having a first end being mechanically connected with said rotary shaft; a second main arm having a first end being pivotally connected to a second end of said first main arm for being capable of varying an angle of said second main arm in relation to said first main arm; a rotation plate having a rotation center over said opening portion and mechanically connected to said first end of said first main arm for rotating in a plane perpendicular to said rotary shaft; and an auxiliary arm having a first end mechanically connected to an eccentric position of said rotation plate, said eccentric position being distanced from said rotation center of said rotation plate, said auxiliary arm having a second end mechanically connected to said second main arm at its position near said first end thereof so that said angle of said second main arm in relation to said first main arm becomes larger when said rotation arm is directed downward and that said angle of said second main arm in relation to said first main arm is smaller when said rotation arm becomes directed upwards, so that when said rotation arm is directed downward, said rotation arm penetrates said opening portion of said chassis wherein a distal end of said rotation arm is below said chassis.

* * * * *